US005198608A

United States Patent [19]

Cahill et al.

[11] Patent Number: 5,198,608

[45] Date of Patent: Mar. 30, 1993

[54] MINE CLEARING RAKE

[76] Inventors: Peter J. Cahill, 7208 Caulking Pl., Burke, Va. 22015; William L. Holland, 4817 Bristow Dr., Annandale, Va. 22003; Sergio A. Sergi, 8570 Koluder Ct., Lorton, Va. 22079; James M. Collins, 2235 Poplar Rd., Stafford, Va. 22554; James M. Dillon, 7202 Valleycrest Blvd., Annandale, Va. 22003; Charles W. Chichester, 14638 Estate Dr., Woodbridge, Va. 22193; Paul T. Kwon, 3850 Appaloosa Dr., Lake Ridge, Va. 22192; Stephen H. Bennett, 7573 Asponpark Rd., Lorton, Va. 22079

[21] Appl. No.: 777,972

[22] Filed: Oct. 17, 1991

[51] Int. Cl.[5] ..... F41H 11/12

[52] U.S. Cl. ..... 89/1.130; 172/832

[58] Field of Search ..... 89/1.13; 171/141; 172/832, 839

[56] References Cited

U.S. PATENT DOCUMENTS

| | | | |
|---|---|---|---|
| 2,341,151 | 2/1944 | Maloon | 89/1.13 |
| 2,486,372 | 10/1949 | Rockwell | 89/1.13 |
| 4,467,694 | 8/1984 | Azulai et al. | 89/1.13 |
| 4,552,053 | 11/1985 | Bar-Nefy et al. | 89/1.13 |
| 4,590,844 | 5/1986 | Bar-Nefy et al. | 89/1.13 |
| 4,727,940 | 3/1988 | Bar-Nefy et al. | 89/1.13 |
| 4,909,330 | 3/1990 | Kasher et al. | 89/1.13 |
| 4,919,034 | 4/1990 | Firth | 89/1.13 |
| 4,938,114 | 7/1990 | Matthews et al. | 89/1.13 |

*Primary Examiner*—David H. Brown

*Attorney, Agent, or Firm*—Anthony T. Lane; William Randolph; Werten F. W. Bellamy

[57] ABSTRACT

A mine clearing rake comprising a rake assembly with alternately disposed large and small teeth which are arranged to form a broad "V" and are rigidly supported laterally by horizontally disposed bars and rods to provide a maximum proportion of open space rearwardly and are supported rearwardly by a rigid reinforcing frame assembly which is attached to the bottom edge of the moldboard of a propelling vehicle, such as a tank, and have four additional points of support and/or attachment to the moldboard. An extension grid assembly is also mounted above the rake assembly to prevent unearthed mines from rolling over the mine clearing rake. A skid shoe assembly is attached to the reinforcing frame assembly and protrudes through the rake assembly so that the skid shoe rests upon the surface of the minefield during operation of the mine clearing rake.

12 Claims, 3 Drawing Sheets

MINE CLEARING RAKE

GOVERNMENT INTEREST

The invention described herein may be manufactured and used by or for the States Government for Governmental purposes without the payment of any royalties and is being assigned to the U.S. Government.

BACKGROUND OF THE INVENTION

1. Field of the Invention

This invention relates to an apparatus for clearing land mines and especially relates to a mine clearing apparatus mountable as an attachment to a bulldozer blade on a vehicle such as a tank. It particularly relates to a mine clearing rake, which is held at a controlled depth for uprooting both surface-laid mines and buried mines and shunting them to the sides of a full width cleared path through a minefield.

2. Review of the Prior Art

Many types of mine clearing apparatuses are known and have been put to use for clearing minefields. These apparatuses include flails, rollers and plows.

U.S. Pat. No. 2,486,372 describes an earth-working implement, such as an excavator, propelled by a combat tank for clearing minefields on land. The implement is a digger of the harrow type that includes a substantially V-shaped moldboard carrying a series of teeth, a horizontal beam lying across the front of the tank in the operative position, and a bar extending along the corresponding side of the vehicle to approximately the midpoint thereof.

U.S. Pat. No. 4,467,694 relates to a track width mine clearing apparatus for attachment to a vehicle and comprises a frame mountable onto a vehicle for selectable positioning in a raised or lowered orientation.

U.S. Pat. No. 4,491,053 describes an apparatus for track width clearing of mines that comprises a frame mountable onto a vehicle for selective positioning in a raised or lowered orientation, a plow apparatus for raising and shunting aside mines, and an apparatus for automatically raising or lowering the plow.

U.S. Pat. No. 4,590,844 discloses a track width mine clearing apparatus for attachment to a vehicle that comprises a selectively raised or lowered frame and an apparatus mounted on the frame for raising and shunting aside mines.

U.S. Pat. No. 4,667,694 relates to an apparatus for clearing light surface laid land mines that includes clearing plates which can freely move up and down independently of one another and are disposed in a movable carrier which is embodied as an attachment for a tracked or wheeled vehicle. The clearing plates are disposed at a slight distance from one another and are arranged in the direction of travel.

U.S. Pat. No. 4,690,030 describes a track width mine clearing apparatus for attachment to a vehicle that comprises a frame mountable on the vehicle, for selectable positioning in a raised or lowered orientation, and an apparatus mounted on the frame for raising and shunting aside mines, including a pair of angled arms having a profile complementary to that of the frame and the vehicle.

U.S. Pat. No. 4,727,940 describes a mine clearing apparatus for attachment to a vehicle and comprising a frame mountable on a vehicle for selectable positioning in a raised or lowered orientation and apparatus mounted o the frame for raising and shunting aside mines, including a plow section that defines a plurality of plow teeth which extend below the ground surface when in operation, and a conveyer apparatus extending along the length of the plow section and adapted to convey the contents of the earth raised by the plow section to one side of the vehicle.

U.S. Pat. No. 4,919,034 discloses a mine clearing apparatus for mounting onto a vehicle that comprises a support adapted to be rigidly fixed to the vehicle and at least one elongate plough blade extending transversely of the path of forward travel of the vehicle and mounted on the support so that each blade is pivotable about a first axis which extends transversely of the path, the plough blade being pivotable also about a second axis which extends substantially perpendicularly to the first axis and approximately parallel to the path of travel of the vehicle.

U.S. Pat. No. 4,938,114 relates to a track width plowing means for dislodging, uplifting, and sweeping aside mines, this means being attached to a crossbeam and located on either side of float shoes that slide along the ground and adjust to maintain a chosen depth of plow, the crossbeam being connected to the front of a vehicle by pushbars that attach to a frame mounting on the vehicle.

All of these devices are adversely affected by power limitations imposed by the choice of push vehicle which limits the width of cleared lane or the depth from which mines can be cleared. In response to this limitation for a tracked combat tank, most devices attempt to clear only a track width lane on each side to allow passage of the tank. Since modern mines are effective against the full width of the tank and since following vehicles cannot travel exactly in the path of the clearing vehicle, track width clearing devices have limited effectiveness in creating a breach through a mine field. The few devices which attempt to clear the entire width of the pushing vehicle are faced with disposing of the large amount of spoil material which accumulates on the moldboard of the apparatus. Those devices which use teeth to lift mines from the soil deposit the mines along with the spoil against a moldboard. All of these apparatuses tend to be heavy if designed to clear land mines and are likely to be seriously damaged by detonation of a mine. Such detonation is also likely to occur in close proximity to the vehicle, whereby the vehicle could be disabled.

Mine detonation under or against a mine clearing apparatus is likely to so damage the apparatus as to not only render it ineffective but also cause the device to severely impede the movement of the vehicle. Since such an event is likely to occur while the vehicle is being fired upon by an adversary, it is highly desirable that the crew be able to disengage the mine clearing apparatus quickly without dismounting from the vehicle.

The heavy weight of these devices, the weight of the spoil and the difficulty of pushing large teeth through the soil to lift buried mines has resulted in power/transmission requirements so severe that no standard combat vehicle can push prior art full width clearing apparatus to excavate and remove buried mines from a mine field. There is accordingly a need for a mine clearing device that is: a) spaced relatively far from the treads and underside of the vehicle, b) is relatively light but unusually rigid and strong, c) includes a means for minimizing blast effects created by detonation of a land mine, thereby protecting both the rake and the propelling vehicle, d) does not have to push excessive amounts of spoil, e) can be disengaged from within the pushing vehicle and f) is easily repairable.

SUMMARY OF THE INVENTION

It is accordingly an object of this invention to provide a mine clearing rake having a means for imparting rigidity without use of large amounts of metal.

It is another object to provide a mine clearing rake having means for dissipating the force of a mine detonation.

It is also an object to provide a mine clearing rake having a means, in combination with the vehicle to which it is attached, that protects the vehicle from damage by mine detonation.

It is still another object to provide a means for preventing mines from rolling over the rake into its supporting structure an into proximity with the vehicle.

It is another object to provide a mine clearing rake requiring a minimum amount of tractive effort.

It is another object to provide full width clearing capability for the main battle tank.

It is another object to provide a quick disconnect means so that the device can be quickly jettisoned without requiring the crew to dismount.

It is another object to provide a wire cutter to permit mine clearing operation through wire obstacles.

It is an object to provide a rake which allows the spoil to pass through it while carrying the mines to the sides of the vehicle path.

It is an object to provide a device which can be carried to the battle area in a raised position so as to avoid impeding mobility and can be lowered into a digging position when required so that the operator's vision is not obstructed by the device in either position, and that raising and lowering can be done entirely with power and controls that currently exist on the pushing vehicle.

It is also an object that the device be easy to install by the crew using only the crew and the organic lifting capability of the combat vehicle.

It is further an object to provide a structure that enables all components to be easily accessible and repairable, that the device be self contained requiring no permanent modification of the pushing vehicle.

In accordance with these objects and the principles of this invention, a preferred embodiment of a mine clearing rake (MCR) is disclosed that is a bolt-on attachment to a moldboard on a Combat Engineer Vehicle (CEV), or a M60 tank equipped with M9 Dozer Kit. This rake is highly suitable for clearing a path through a minefield under combat conditions, whereby other vehicles can safely follow and traverse the minefield. The rake is positioned so that when the device is lowered into the soil to remove mines, the vehicle moldboard is sufficiently above the ground to allow the spoil to pass under it without impeding vehicle progress. The rake is positioned sufficiently in advance of the moldboard that if detonations occur, their blast effects do not significantly affect the vehicle. Moreover, because of this implementation such detonations tend to occur within a moving mass of earth. The rake has almost no resistance to rearward detonating forces. These mine detonating forces are substantially dissipated, without serious damage to the rake, until the moldboard itself is contacted by flying particles, whereby, in combination with the moldboard, the vehicle is still further protected. This mine clearing rake possesses a structure that is rigidly reinforced in three dimensions but is relatively light, whereby the use of steel is minimized.

The specific embodiment of the mine clearing rake disclosed herein is designed to be attached to the moldboard of a Combat Engineering Vehicle or an M60 tank with an M9 blade. After the mine clearing rake is installed, the moldboard controls are used to initially lower the mine clearing rake and to raise it to the travel position. During mine clearing operations, the vehicle moldboard control lever is in the float position.

The mine clearing rake is triangularly shaped when viewed from its top. When installed, the mine clearing rake points forward, and the base of its triangle is parallel with the moldboard.

The mine clearing rake is designed to be used primarily in sandy or loose soil for plowing up both surface laid and buried land mines. Each side of the mine clearing rake has a row of teeth extending diagonally from the apex to the rear of the mine clearing rake. When the moldboard is lowered, the mine clearing rake teeth dig into the ground. A skid shoe extends from the front of the mine clearing rake and exerts pressure on the ground to control the depth to which the teeth penetrate.

The skid shoe is designed with deliberate flaw lines such that if a mine detonates under the shoe, the shoe itself will destruct so as to minimize the amount of shock that will be transmitted to the rest of the Mine Clearing Rake. This feature of the skid shoe minimizes damage to the rake assembly which would normally be caused by a large blast under the shoe.

If the shoe is so blown away by a mine, the operator can continue to drive through the mine field by using the hydraulic controls for the blade to control depth of penetration of the rake teeth.

The mine clearing rake has two sizes of teeth, large and small. The teeth are alternated along each side; one large, one small, another large, and so forth. In a preferred embodiment the large teeth dig about 12 inches into the ground, to rake up buried mines, while the tips of the small teeth skim just below the ground surface, thereby minimizing resistance to forward movement. The spacing between the teeth is designed to ease the passage of soil, but prevent antitank mines from passing between the teeth. The teeth slant rearward so that mines raked from the ground will be lifted and rolled upward and back along each side of the mine clearing rake, thus clearing a lane that is about 15 feet wide in a preferred embodiment.

If an anti-tank mine does detonate in close proximity to the mine clearing rake, most of its blast force passes between the vertically disposed teeth and between the horizontally disposed support bars and rods that impart rigidity to the teeth. If any damage is nevertheless done, all parts of the mine clearing rake are easily accessible from almost all directions so that bent areas can be easily cut out and replaced with new metallic alloy (i.e. steel or aluminum) plate or rod which is also easily welded into place.

While the invention has been disclosed as being made of steel it could also be made of other metal such as aluminum or any suitably rigid material. Aluminum, being of lighter weight than steel, would yield a lighter mine clearing rake structure thereby reducing the additional weight carried by the pusher vehicle.

The mine clearing rake of this invention is operable with a vehicle having a moldboard for clearing a path through a minefield in sand and loose earth, wherein both surface-laid mines and buried anti-tank mines are disposed. One specific implementation of the mine clearing rake comprises:

A. a rake assembly having a plurality of curved teeth disposed in parallel and in dihedral relationship to the longitudinal axis of the vehicle;

B. a reinforcing frame assembly to provide three-dimensional support to the rake assembly;

C. an extension grid assembly, disposed above and attached to the rake assembly, which prevents unearthed mines from rolling over the mine clearing rake; and D. a means for mounting the mine clearing rake onto the moldboard, whereby controlled movement of the moldboard creates controlled movement of the mine clearing rake;

E. Skid shoe for depth control;

F. Wire cutter;

G. A means for quick disconnect.

The plurality of curved teeth comprise a plurality of large teeth for unearthing the anti-tank mines and a plurality of small teeth for removing the surface-laid mines, the large teeth and the small teeth being disposed alternately.

In a preferred embodiment the mine clearing rake further comprises a quick disconnect means for rapidly separating the mine clearing rake from the vehicle, this means comprising a disconnect hook which is placed over the top edge of the moldboard, a disconnect anchor chain which is attached to the reinforcing frame assembly, a chain, disconnect pin and hook assembly which is attached to the vehicle, and fastens together with anchor chain and the disconnect hook.

The reinforcing frame assembly comprises a laterally disposed rear member, a laterally disposed forward member, a central longitudinal member, a plurality of outer longitudinal members, and a pair of backup members disposed in the dihedral relationship, all of these members being welded together at every intersection thereof and the rake assembly being welded to the backup members.

The cross-sectional shape of the laterally disposed rear member is a "V" lying on its side, open toward the rear of the vehicle, and the bottom edge of the moldboard fits into this open "V". Vertical lock brackets are attached to the top edge of the moldboard and vertical lock bars are hooked into the brackets and to the laterally disposed rear member for compressing the bottom edge of the moldboard against and into the "V".

Spacer supports are attached to the top edge of the rake assembly and spacer bolts are attached to the spacer supports and are adjusted in length to apply a compressive force against the upper portion of the moldboard. A pair of turnbuckles and chain assemblies are attached to the vertical lock bars and to the top edge of the rake assembly and are disposed in crossed relationship to provide tension for stabilizing the mine clearing rake.

The rake assembly further comprises a central opening, and a skid shoe assembly is attached to the central longitudinal member and protrudes through the central opening. This skid shoe assembly comprises a skid shoe which is disposed in front of the rake assembly and presses against the surface of the minefield during mine clearing operations of the vehicle and the rake assembly.

DESCRIPTION OF THE PREFERRED EMBODIMENT

Figure 1:
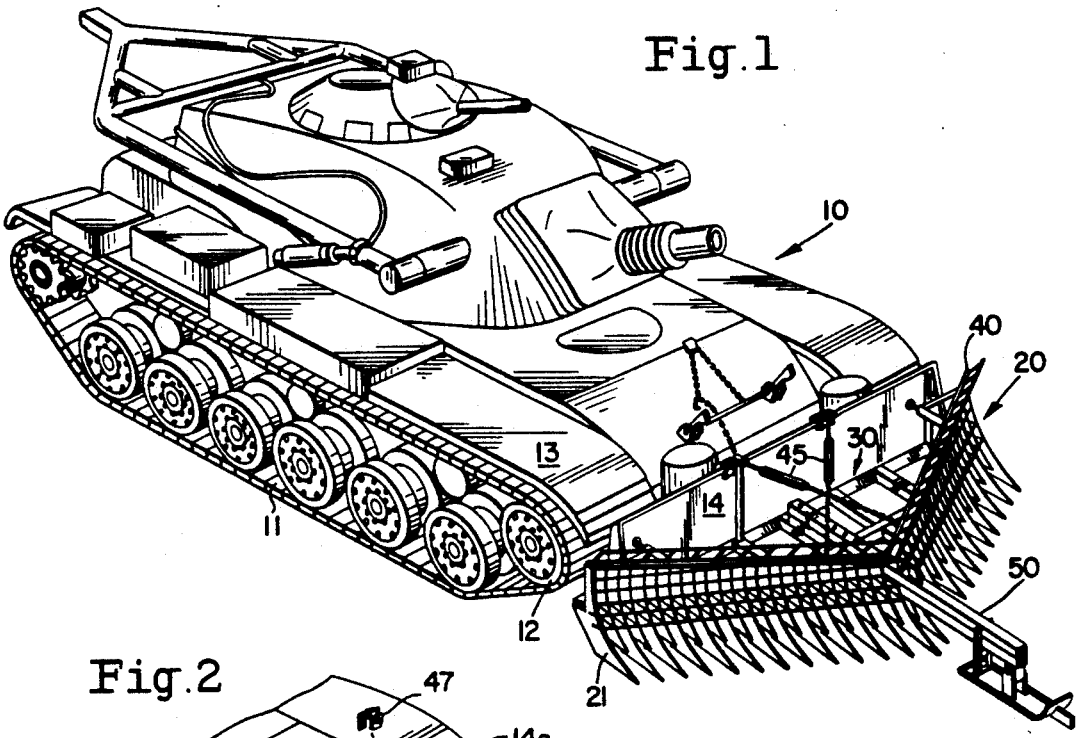
FIG. 1 is a perspective elevational view of the mine clearing rake mounted on the moldboard of a tank as the propelling and controlling vehicle.

The mine clearing rake of this invention is shown in FIG. 1 in operating position while attached to moldboard 14 of tank 10 which has wheels 12, treads 11, and fenders 13. This rake comprises a rake assembly 20, reinforcing frame assembly 30, extension grid 40, and skid shoe assembly 50 which projects ahead of rake assembly 20 and rests on the ground during normal operation of the mine clearing rake.

Figure 9:
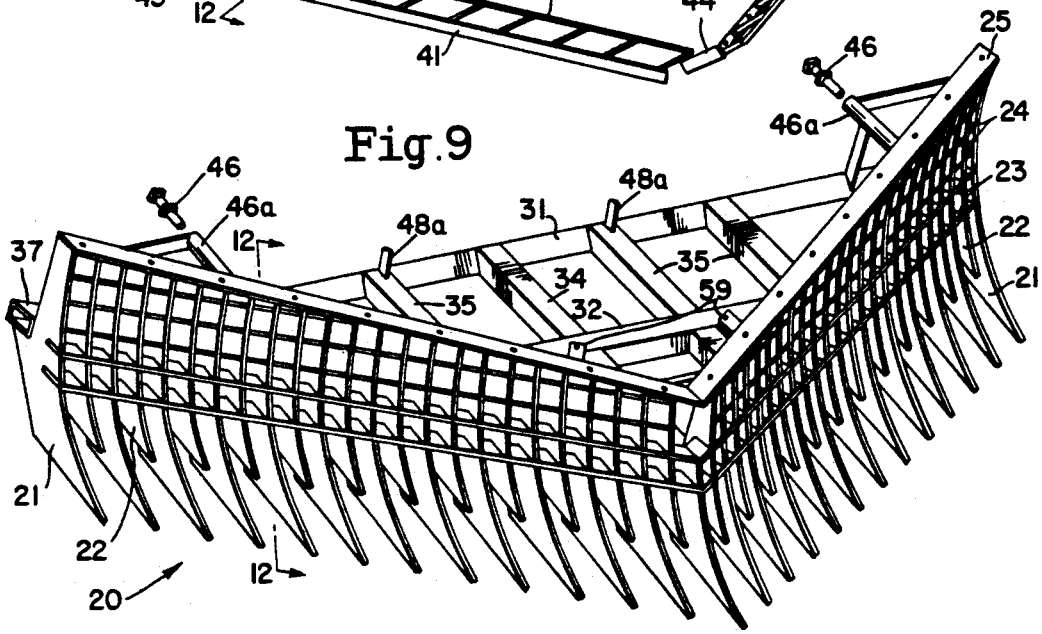
FIG. 9 is a perspective view of the rake assembly.
Figure 12:
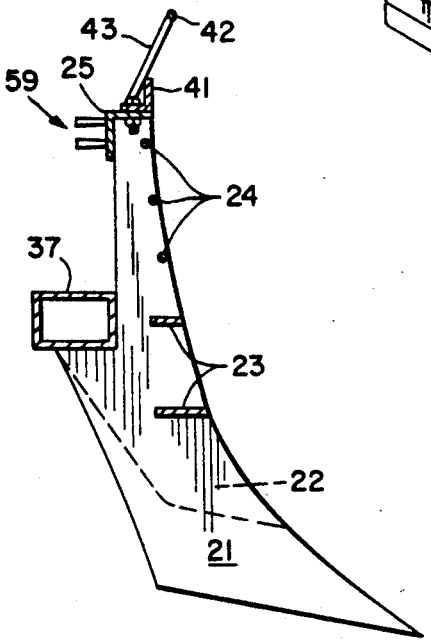
FIG. 12 is a sectional elevation of the rake assembly and the extension grid assembly, taken in the direction of the arrows 12—12 in FIGS. 9 and 10.

As shown in FIGS. 1, 9, and 12, rake assembly 20 is built in two parts in dihedral relationship and comprises a plurality of large teeth 21 and a plurality of small teeth 22, two horizontal bar supports 23, two to three horizontal rod supports 24, and a top angle iron 25. Rake assembly 20 is surmounted by extension grid assembly 40 and is longitudinally and laterally supported by reinforcing frame assembly 30. Teeth 21, 22 are alternately arranged, as shown in FIGS. 1 and 9, in a preferred embodiment teeth 21 o the outer ends of the rake are approximately twice as thick as all other teeth 21. Large teeth 21 lift mines buried to a depth of about twelve inches. Small teeth 22 lift shallowly buried and surface laid mines.

Figure 8:
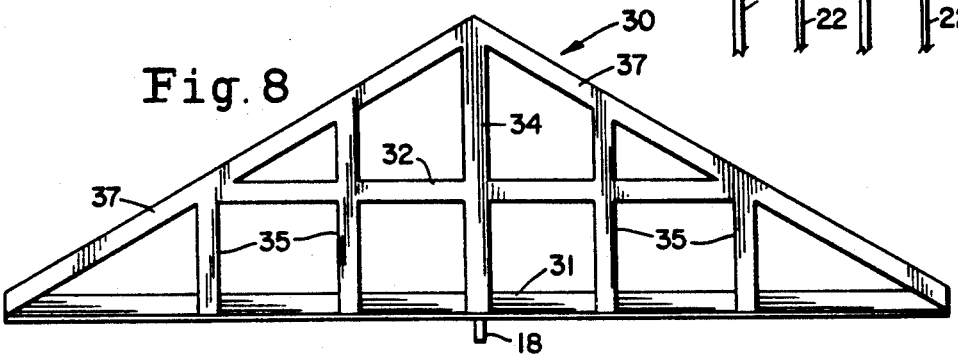
FIG. 8 is a plan view of the reinforcing frame assembly.
Figure 10:
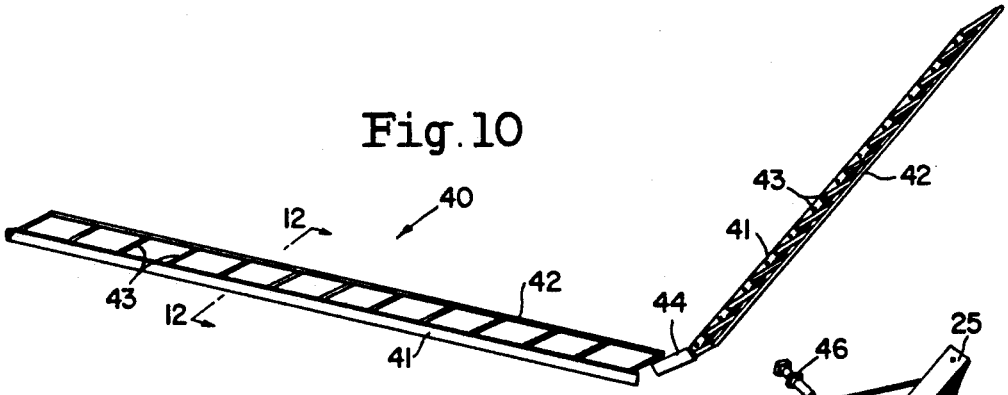
FIG. 10 is a perspective view of the extension grid and wire cutter assembly in exploded relationship to the rake assembly.
Figure 14:
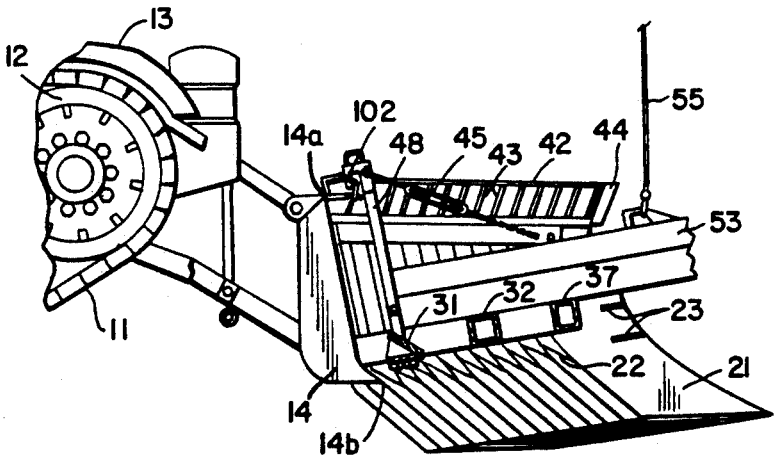
FIG. 14 is a sectional elevational view of the front of the tank and of the rake and extension grid assemblies, immediately before fitting them onto the moldboard.

Referring to FIG. 8, reinforcing frame assembly 30 comprises rear lateral member 31, forward lateral member 32, central longitudinal member 34, four outer longitudinal members 35, and inclined backup members 37, all of which are rigidly welded to form a framework that furnishes three-dimensional support for rake teeth assembly 20, in a preferred embodiment members 32, 34, 35, 37 are box-shaped in cross section, as seen in FIGS. 9 and 12 with respect to member 37, and member 31 is V-shaped, as seen in FIG. 14.

Figure 11:
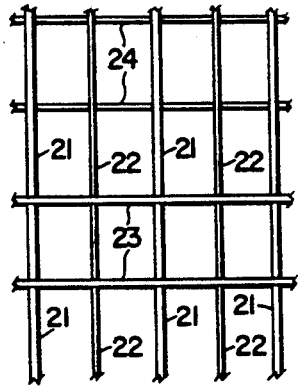
FIG. 11 is a front elevation of a portion of the rake assembly.

The rigidity of support for teeth 21, 22 that is provided by bars 23 and rods 24 can be understood from FIGS. 11 and 12, as well as FIGS. 1 and 9, which show the nearly square relationship of teeth 21 and 22, bars 23, and rods 24, more extended support being provided in the travel direction with increased proximity to the ground.

Extension grid assembly 40, (having left and right grids which are not interchangeable) comprises bottom angle irons 41, top bars 42, a plurality of inclined bars 43, and a centrally disposed wire cutter 44. When bolted to the top of rake assembly 20, this assembly 40 prevents plowed mines from riding over the top of the mine clearing rake. Wire cutter 44 has a sharp leading edge 80 which cuts wire that is pressed into contact with it by the forward movement of the rake.

Figure 2:
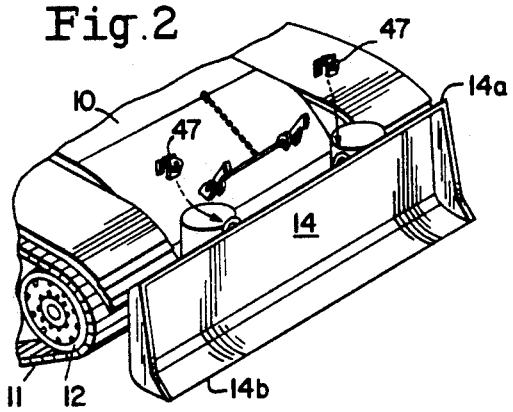
FIG. 2 is a perspective fragmentary view of the tank and its moldboard shown in FIG. 1.
Figure 3:
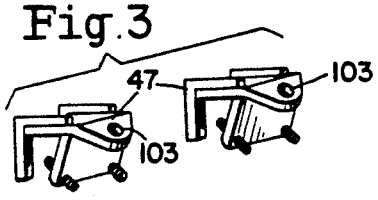
FIG. 3 is a perspective view of a pair of vertical lock bar brackets which are attached to the top edge of the moldboard.

The mine clearing rake can be described more fully by referring to its mounting and attachment procedure. FIG. 2 furnishes a clear view of the front portion of tank 10 and moldboard 14 as vertical lock brackets 47, seen in detail in FIG. 3, are being positioned onto top edge 14*a* of moldboard 14 and over the moldboard's left and right lifting rings which are welded onto the rear side of the moldboard.

Figure 5:
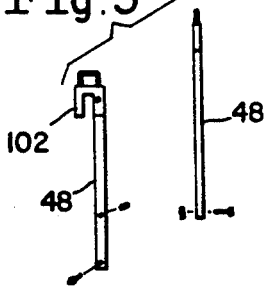
FIG. 5 is an elevational view of the pair of vertical lock bars, showing both the front and side thereof.
Figure 4:
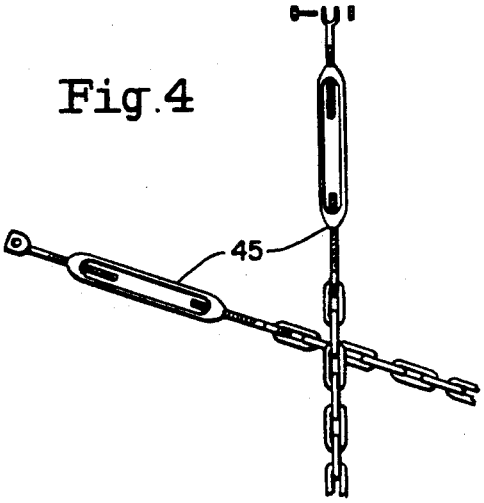
FIG. 4 is a plan view of the pair of turnbuckle and chain assemblies in crossed relationship.

Vertical lock bars 48, seen in FIG. 5, are hooked into brackets 47 and attached to lock bar lugs 48*a* which are welded to member 35. Chain and turnbuckle assemblies 45, shown in detail in FIG. 4, are also attached to vertical lock bars 48 and to lugs 59 (FIG. 9 and 12) attached to angle irons 25 at the top edge of rake assembly 20, as seen in FIG. 1, 9, 12 and 14. Chain and turnbuckle assemblies 45 provide tension to stabilize the mine clearing rake.

Upper spacer bolts 46 are attached to spacer supports 46*a* and then tightened against moldboard 14, as seen in FIGS. 1 and 9. These spacer bolts are used to adjust the position of the mine clearing rake after it is mounted onto moldboard 14.

Figure 15:
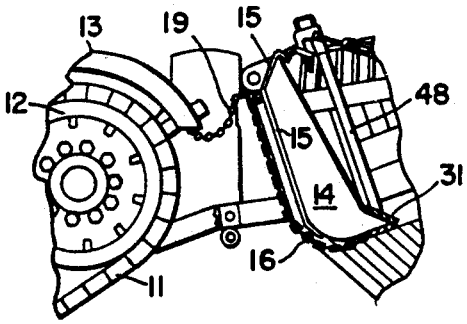
FIG. 15 is a sectional elevational view, similar to FIG. 14, except that the assemblies are fragmentary and are fully attached to the moldboard with a bracket and vertical lock bar in place and the quick disconnect means attached to the reinforcing frame assembly and to the tank.

FIGS. 14 and 15 illustrate the procedure for attaching the mine clearing rake to moldboard 14. Using lift cable 55, as seen in FIG. 14, the mine clearing rake is adjusted in position so that V-shaped lateral member 31 is level with and in front of bottom edge 14*b* of moldboard 14. The vehicle is then moved forward to put bottom edge 14*b* within the "V" of member 31, as seen in FIG. 15.

Figure 7:
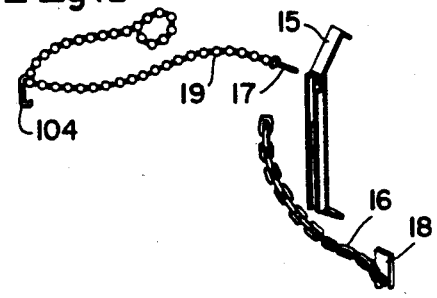
FIG. 7 is a perspective view of the quick disconnect means.

As part of the quick disconnect system for the mine clearing rake, as shown in FIGS. 1, 7, and 15, disconnect hook 15 is placed in the center and hung over the back of moldboard 14. The anchor chain 16 which is attached to the chain anchor member 18 that is on the bottom of lateral member 31, is attached to the disconnect hook 15 with disconnect pin 17, thereby holding the mine clearing rake to the base of moldboard 14. Disconnect pin release chain and hook 19 is secured to the top of disconnect pin 17 and is placed over the front of the vehicle 10 where it can be reached by the vehicle operator from his seated position in the vehicle. The disconnection of the rake assembly requires the operator to hydraulically raise the moldboard 14, reposition the hook item 104 of the hook and chain 19, then lower the moldboard, thereby using the weight of the rake assembly and moldboard to extract the disconnect pin 17 releasing the rake assembly from the vehicle.

Figure 13:
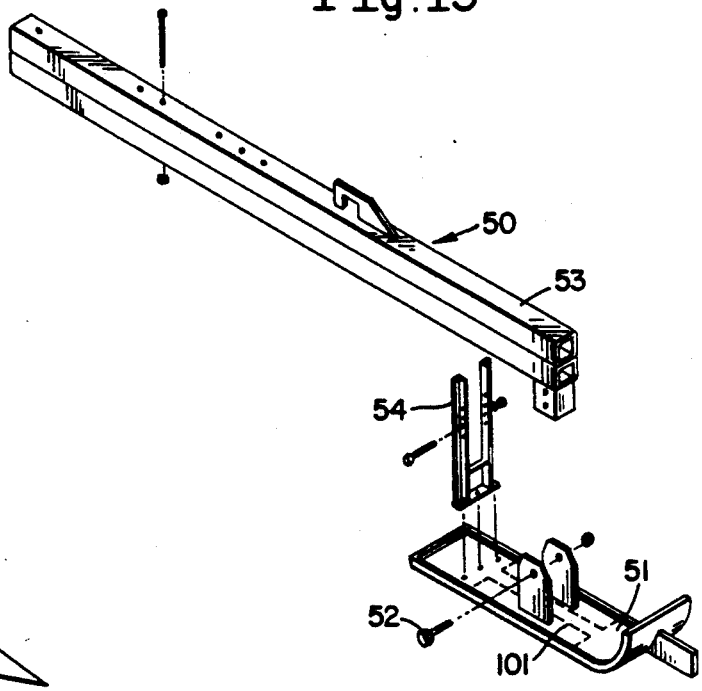
FIG. 13 is an exploded perspective view of the skid shoe assembly.

Referring to FIG. 13, skid shoe assembly 50 comprises skid shoe 51, skid shoe pin 52, skid shoe support 53, and skid shoe adjustable rear support 54. Skid shoe 51 exerts pressure on the ground surface to control penetration depth of the teeth. Skid shoe pin 52 secures skid shoe 51 to skid shoe support 53 and provides depth control adjustment. Skid shoe support 53 is bolted to central longitudinal member 34 and extends through a central opening in rake assembly 20 to support skid shoe 51. Skid shoe adjustable rear support 54 is bolted to the rear of skid shoe 51 and provides a means of adjusting the attitude of skid shoe 51.

Skid shoe 51 is built so that it is substantially less able than the remainder of the rake to survive a mine blast so that it will absorb energy from the blast.

Dotted lines 101 on shoe 51 show the outline of reinforcing plates which extend from about the side of the shoe but do not connect in the middle of the shoe. This creates fault line down the middle of the shoe.

Figure 6:
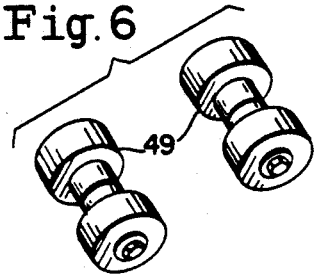
FIG. 6 is a perspective view of the pair of moldboard lift pins.

During operation of the mine clearing rake, the pins in the moldboard hydraulic cylinder rod ends are replaced with moldboard lift pins 49, shown in FIG. 6, in order to allow the moldboard/rake to float freely.

The foregoing description of a preferred embodiment of the invention has been presented for purposes of illustration and description and is not intended to be exhaustive or to limit the invention to the precise form disclosed. It was chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended hereto.

What is claimed is:

1. A mine clearing device for clearing a path through a minefield in sand and loose earth, wherein both surface-laid mines and buried anti-tank mines are disposed, that is attached to a moldboard plow having a vertically disposed elongated rectangular blade with upper and lower lateral edge portions and where the moldboard plow is mounted on a vehicle, the mine clearing device comprising:

a rake assembly for unearthing and disposing of buried and surface laid mines comprising a plurality of elongated teeth which are generally vertically disposed so that the teeth have upper and lower end portions and the elongated teeth are disposed in parallel spaced apart relationship, and a plurality of elongated connecting members which are generally horizontally disposed and which are connected to each of the elongated teeth in spaced apart relationship so that an open gridwork is formed between the spaced apart elongated teeth and connecting members that generally extends between the upper and lower end portions of the elongated teeth;

a reinforcing frame assembly which is laterally supported on the moldboard plow and which is connected to the rake assembly for supporting it in operative condition comprising a laterally disposed backup member which is connected to the open gridwork of elongated teeth of the rake assembly, a laterally disposed support member which is spaced from and positioned rearwardly of the backup member and the rake assembly and which is supported from the surface of the moldboard plow, and a plurality of spaced longitudinal members which extend between and are connected to the backup member and the support member;

a skid shoe assembly for supporting the rake assembly at a predetermined penetration depth, comprising a skid shoe having a planar surface for contacting the surface of the ground, an elongated skid shoe support connected to the rake and reinforcing frame assemblies for supporting the skid shoe forwardly of the rake assembly, and adjustment means connected to the skid shoe and the elongated skid shoe support for adjusting the attitude of the skid shoe and the penetration depth of the rake assembly; and means connected to the rake assembly, the reinforcing frame assembly and the moldboard plow for supporting the rake assembly in a fixed position on the moldboard plow.

2. The mine clearing device according to claim 1, wherein the rake assembly is elongated and the rake assembly is generally V-shaped in plan view with the central portion of the rake assembly spaced further from the moldboard plow than the end portions so that as sand or earth and mines are unearthed, a portion of the unearthed material is directed toward the opposite end portions of the rake assembly and the remainder passes through the open gridwork of the rake assembly.

3. The mine clearing device according to claim 1, wherein only the lower end portions of the elongated teeth are designed to be inserted in the sand or earth so that a portion of the unearthed material and blasts from exploding mines pass through the open gridwork of the rake assembly.

4. The mine clearing device according to claim 1, wherein the plurality of elongated teeth include long teeth and short teeth which are positioned so that lower end portions of the long teeth extend below the lower end portion of the short teeth, so that the long teeth penetrate deeper into the sand or earth than the short teeth for unearthing buried mines.

5. A mine clearing device for unearthing both surface-laid mines and buried anti-tank mines and which is secured to a motorized vehicle that pushes the mine clearing device ahead of the vehicle, comprising:

a rake assembly for unearthing and disposing of buried and surface laid mines comprising a plurality of elongated teeth which are generally vertically disposed so that the teeth have upper and lower end portions and the elongated teeth are disposed in parallel spaced apart relationship, and a plurality of elongated connecting members which are generally horizontally disposed and which are connected to the elongated teeth in spaced apart relationship so that an open gridwork means is formed between the spaced apart elongated teeth and connecting members that extends from the lower end portion of the elongated teeth to at least the intermediate portions thereof so that a portion of the unearthed material and blasts from exploding mines pass through the open gridwork means;

a reinforcing frame means connected to the rake assembly for reinforcing and supporting the rake assembly in operative condition;

a skid shoe means connected to the rake assembly and reinforcing frame means for limiting the penetration depth of the rake assembly; and mounting means connected to the motorized vehicle, the rake assembly, and the reinforcing frame means for supporting the rake assembly from the motorized vehicle.

6. The mine clearing device according to claim 5, wherein the plurality of elongated teeth include a plurality of large teeth for unearthing buried mines and a plurality of small teeth for removing surface laid mines, wherein the large teeth are longer than the small teeth and the large teeth and the small teeth are disposed alternatively in the rake assembly so that a small teeth is positioned between adjacent large teeth.

7. The mine clearing device according to claim 5, wherein the skid shoe means comprises a skid shoe having a planar surface for contacting the surface of the ground, an elongated skid shoe support connected to a central portion of the rake assembly and reinforcing frame means for supporting the skid shoe forwardly of the rake assembly, and adjustment means connected to the skid shoe and the elongated skid shoe support for adjusting the attitude of the skid shoe and the penetration depth of the rake assembly.

8. The mine clearing device according to claim 5, wherein the rake assembly is generally V-shaped in plan view with the central portion of the rake assembly spaced further from the vehicle than the end portions and the open gridwork extends from the lower end portion of the teeth to the upper end portion of the teeth, so that as sand or earth and mines are unearthed, a portion of the unearthed material is directed toward the opposite end portions of the rake assembly and the remainder passes through the open gridwork of the rake assembly.

9. The mine clearing device according to claim 8, wherein the plurality of elongated teeth include long teeth and short teeth which are positioned so that lower end portions of the long teeth extend below the lower end portion of the short teeth.

10. The mine clearing device according to claim 9, wherein the skid shoe means comprises a skid shoe having a planar surface for contacting the surface of the ground, an elongated skid shoe support connected to the rake assembly for supporting the skid shoe forwardly of the rake assembly, and adjustment means connected to the skid shoe and the elongated skid shoe support for adjusting the attitude of the skid shoe and the penetration depth of the rake assembly.

11. The mine clearing device according to claim 10, wherein the reinforcing frame means comprises a laterally disposed backup member which is connected to the open gridwork of the elongated teeth and connecting members, a laterally disposed support member which is spaced from the backup member and positioned rearwardly of the rake assembly, and a plurality of spaced longitudinal members which extend between and are connected to the backup member and the support member.

12. A method for clearing surface-laid and larger buried mines from sand and loose earth with a mine clearing device having an open gridwork rake assembly of vertically disposed spaced apart elongated teeth members connected to laterally disposed spaced apart elongated connecting members which form an open gridwork from the top to the bottom of the rake assembly, and where some of the elongated teeth are longer than other elongated teeth for penetrating the earth deeper than the shorter elongated teeth for unearthing buried mines and the mine clearing device also having a skid shoe attached to the rake assembly for controlling the penetration depth of the rake assembly, comprising the steps of pushing the mine clearing device through sand or earth so that the longer elongated teeth penetrate the earth to a predetermined depth to unearth buried mines, moving a portion of the unearthed material away from the path of the mine clearing device and directing the remaining portion of material through the open gridwork of the rake assembly so that blasts from exploding mines are directed through the open gridwork.

* * * * *